US008651816B2

(12) United States Patent
Koike

(10) Patent No.: US 8,651,816 B2
(45) Date of Patent: Feb. 18, 2014

(54) FAN BLADE CONNECTION

(75) Inventor: Bento Massahiko Koike, Sorocaba (BR)

(73) Assignee: Fantech Tecnologia em Sistemas de Ventilacao Ltda, Sao Paulo (BR)

( * ) Notice: Subject to any disclaimer, the term of this patent is extended or adjusted under 35 U.S.C. 154(b) by 543 days.

(21) Appl. No.: 12/529,975

(22) PCT Filed: Mar. 6, 2007

(86) PCT No.: PCT/IB2007/050726

§ 371 (c)(1),
(2), (4) Date: Sep. 4, 2009

(87) PCT Pub. No.: WO2008/107738

PCT Pub. Date: Sep. 12, 2008

(65) Prior Publication Data

US 2010/0086408 A1 Apr. 8, 2010

(51) Int. Cl.
*F04D 29/34* (2006.01)

(52) U.S. Cl.
USPC ..... 416/204 R

(58) Field of Classification Search
USPC ..... 416/204 R, 210 R, 248, 231 R, 235
See application file for complete search history.

(56) References Cited

U.S. PATENT DOCUMENTS

| | | | | |
|---|---|---|---|---|
| 2,587,247 | A | 2/1952 | Turner | |
| 3,480,373 | A * | 11/1969 | Talbot | 416/226 |
| 4,260,332 | A * | 4/1981 | Weingart et al. | 416/226 |
| 4,412,784 | A * | 11/1983 | Wackerle et al. | 416/230 |
| 4,915,590 | A | 4/1990 | Eckland et al. | |
| 5,458,465 | A * | 10/1995 | von Wieser et al. | 416/214 R |
| 6,371,730 | B1 * | 4/2002 | Wobben | 416/244 R |
| 6,537,031 | B1 * | 3/2003 | Bacskay | 416/207 |

FOREIGN PATENT DOCUMENTS

| | | |
|---|---|---|
| BR | 8900333 | 5/1989 |
| BR | 8200229 U | 6/2002 |
| BR | 8200250 U | 7/2002 |
| BR | 0201725 | 9/2002 |
| BR | 8200206 U | 9/2003 |

(Continued)

OTHER PUBLICATIONS

Hau Erich Ed-Hau E: "Windkraftanlagen" Windkraftanlagen. Grundlagen, Technik, Einsatz, Wirtschaftlichkeit, Berlin : Springer, DE, 1996, pp. 186-213; XP002143305 ISBN: 3-540-57430-1.

*Primary Examiner* — Nathaniel Wiehe
*Assistant Examiner* — Adam W Brown
(74) *Attorney, Agent, or Firm* — Sughrue Mion, PLLC

(57) ABSTRACT

A fan blade connection system and method for connecting at least one composite blade (110) to a rotor hub (120), more particularly, for fans used in industrial ventilation and cooling applications. The invention aims to provide a better connection, mainly in regard to the stresses distribution. The preferred embodiments are directed to a system and method for connecting a composite blade (110) to a rotor hub (120) comprising a fastener element (130) arranged in the blade root (111) and extending transversally to the longitudinal axis of the blade (110), said fastener element (130) being adapted for receiving one of the ends of a tensioning member (140) in a longitudinal position in relation to said blade (110). The tensioning member (140) may have an intermediary interface (160) between the blade (110) and the rotor hub (120), fixed by the end of the tensioning member, or fixed by at least one fastener component, which passes through holes in the rotor hub and in the intermediary interface.

14 Claims, 4 Drawing Sheets

(56) References Cited

FOREIGN PATENT DOCUMENTS

| | | | |
|---|---|---|---|
| BR | 0302441 | | 7/2005 |
| BR | 0302858 | | 7/2005 |
| GB | 843995 | A | 8/1960 |
| GB | 1165738 | | 10/1969 |
| JP | 63-085202 | | 4/1988 |
| JP | 63309404 | A | 12/1988 |
| JP | 03-015669 | | 1/1991 |
| JP | 07-012096 | | 1/1995 |
| JP | 08093631 | A | 4/1996 |
| JP | 08-270540 | | 10/1996 |
| JP | 11-022696 | | 1/1999 |
| JP | 11-182408 | | 7/1999 |
| JP | 2000-314392 | | 11/2000 |
| WO | 94/09277 | A1 | 4/1994 |
| WO | 97/41355 | A1 | 11/1997 |
| WO | 01/42647 | A2 | 6/2001 |
| WO | 01/79705 | A1 | 10/2001 |

* cited by examiner

FAN BLADE CONNECTION

TECHNICAL FIELD

The present invention relates to a fan blade connection system and method for connecting at least one composite blade to a rotor hub, more particularly, a fan blade connection for fans used in industrial ventilation and cooling applications.

BACKGROUND ART

Fans are well know in the prior art. Their designs, elements and materials vary depending upon the application. Typical applications of fans are ventilation and cooling for industrial or residential use. For instance, typical cooling and ventilation in industrial applications may be cooling towers, air-cooled condensers, cooling in petrochemical applications, heat exchangers, road tunnels, mining, subways, large buildings, etc.

Basically, a fan comprises at least one fluid reaction surface, usually called 'blade', and a rotor hub wherein the blade is connected. The blades and rotor hub may be manufactured in a single piece, usually for very small fans. Nevertheless, industrial applications usually require larger fans, whose blades and hub are separate pieces that must be connected together. The term 'connection' or 'connecting' is used herein in a broad sense meaning putting the pieces together, fixing, attaching, coupling, joining, fastening or the like. There are many systems for connecting a fan blade in the prior art, for instance BRPI0302441-5, BRPI0302858-5, BRPI8900333-0, BRPI0201725-3, BRMU8200206-1, BRMU8200229-1, BRMU8200250-9; WO97/41355; JP2000-314392; JP07-012096; JP63085202; JP11022696; JP63309404, U.S. Pat. No. 5,458,465 and GB843995.

The adopted connection system may determine important features of the fan related to the assembly, operation and maintenance, such as: adjustment of the pitch angle, the fan blade substitution or fan blade adjustment without interference in the other blades, the blade substitution or blade adjustment with the fan mounted inside the equipment where it will be operated, etc.

Blades for industrial applications are usually made of metal or of a composite material. In such cases, the blades can be massive or hollow, as well as they can possess characteristics of shells. The composite material of the blade can be, for instance, a fibre reinforced laminate, or a fibre reinforced plastic (FRP), or other filament and resin composite. Composite blades usually have the advantage to add to all the advantages of blades in composed material in relation to the blades in metallic material, such as the possibility of optimization of the blade geometry, light weight, high resistance and bigger damping of vibrations. In the case of blades made of composite materials, the connection system usually comprises a projected integral portion in the blade also in composite material or in a metallic material, said projected portion being connected to the rotor hub. In the case of metallic blades, threaded elements or welding are commonly used to make the connection.

There is a special kind of fan, more commonly known as 'wind turbine', which is used for the particular purpose of converting kinetic energy of the wind into mechanical energy. When this mechanical energy is used directly by the machinery (e.g. pumps), the wind turbine is usually called windmill; when the mechanical energy is converted into electricity, the wind turbine is called 'wind generator' or simply 'wind energy turbine'. Due to the differences in the purposes, the rotor hub and the blades of medium or large wind energy turbine usually comprise significant differences from a rotor hub of a fan for a medium or large industrial application. There are many systems for connecting a wind turbine blade in a wind turbine rotor hub, for instance U.S. Pat. No. 4,260,332, U.S. Pat. No. 4,915,590, U.S. Pat. No. 6,371,730; WO01/79705; JP3015669; JP8093631; JP8270540 and JP11182408.

DISCLOSURE OF INVENTION

Technical Problem

In the case of fans for industrial applications with blades made of composite material, the use of a projected portion, also of composite material, integral with the blade has the disadvantage of the connection presenting an undesired adaptation after some time of operation. This adaptation requires periodic inspection and maintenance. On the other hand, metallic projected portions need to be large enough to distribute the stresses throughout the composite blade root, thus these kind of connection usually becomes heavier and expensive. The use of threaded elements is not suitable for directly fastening composite blades because the composite materials have low strength against concentrated stresses. Therefore, there still is the need of a better fan blade connection system for connecting composite blades to a rotor hub, more particularly, a fan blade connection system for fans used in ventilation and cooling for industrial applications.

Technical Solution

To solve the related technical problems and other disadvantages not mentioned herein, certain embodiments of the present invention are directed to a fan blade connection system for connecting at least one composite blade to a rotor hub comprising at least one fastener element arranged in the blade root and extending essentially transversally to the longitudinal axis of the blade, said fastener element being adapted for receiving one of the ends of at least one tensioning member in a relatively longitudinal position in relation to said blade.

In one exemplary embodiment of the present invention, said fastener element is a barrel nut or cross dowel, a channel nut, a cross bolt, a teebolt, a clip, a nut with spring clips, or a similar element suitable to be inserted or moulded into the fan blade and to provide a fixed connection for the tensioning member. In another embodiment of the present invention, said fastener element is suitable for receiving more than one tensioning member. In yet another exemplary embodiment, said fastener element is inserted into a hole that completely or partially passes through the blade. In another exemplary embodiment, said tensioning member is a stud, a screw, a bolt, or a similar member suitable to fixedly connect one of its ends to the fastener element arranged inside the blade. In still another embodiment of the present invention, the end of the tensioning member that is not connected to the fastener element is connected to one of the holes in the rotor hub. In yet another exemplary embodiment, the tensioning member may have an intermediary interface part between the blade and the rotor hub, which may be formed integrally with the tensioning member or a separate part. The term 'part' is not limited to a plate, plain sheet or lamina; it can be understood as having any other format. The end of the tensioning member that is not connected to the fastener element may completely or partially fix an intermediary interface part to the blade base. Said intermediary interface part may be metallic and may be optionally positioned in a recess made in the blade base. In a further embodiment of the present invention, the attachment between the blade and the rotor hub is provided by at least one fastener component, such as a bolt or a screw, which passes through a hole in the rotor hub and in the intermediary interface part connecting the said rotor hub to the said intermediary interface part. In another embodiment, the rotor hub holes for the fastener component may be of a non circular shape, such as oblong, rip or the like and optionally at least one of the holes may have a circular shape.

Advantageous Effects

The present invention has several advantages over the prior art. The use of a fastener element in conjunction with a tensioning member, as first addressed here above, allows a better distribution of the stresses throughout the blade root without using a complex structure. This better distribution of stresses is quite desirable, since it allows a reduction in the weight of the blade, especially in the case of composite blades, which are more sensible to concentrated stresses when comparing to metallic blades. In addition, the fastener member and the tensioning member do not necessarily need to be custom made, and do not need heavy machinery for assembly. Barrel nuts and studs, for instance, are easily found in the market and are very suitable for the present invention. Hence, the fastening element and the tensioning member may be threaded, providing a connection system applicable to composite blades with all the advantages of threaded fastenings. Furthermore, the intermediary interface part may provide a suitable means for avoiding direct contact between the composite blade and the rotor hub, which is commonly metallic. Thus the present invention provides a very efficient, non-expensive, rigid, long-lasting and secure connection between a composite fan blade and a rotor hub, mainly for medium and large ventilation and cooling applications.

DESCRIPTION OF DRAWINGS

The accompanying drawings are not intended to be drawn on scale. In the drawings, each identical or nearly identical component that is illustrated in various figures is represented by a like numeral. For purposes of clarity, not every component may be labelled in every drawing.

MODE FOR INVENTION

Figure 1:
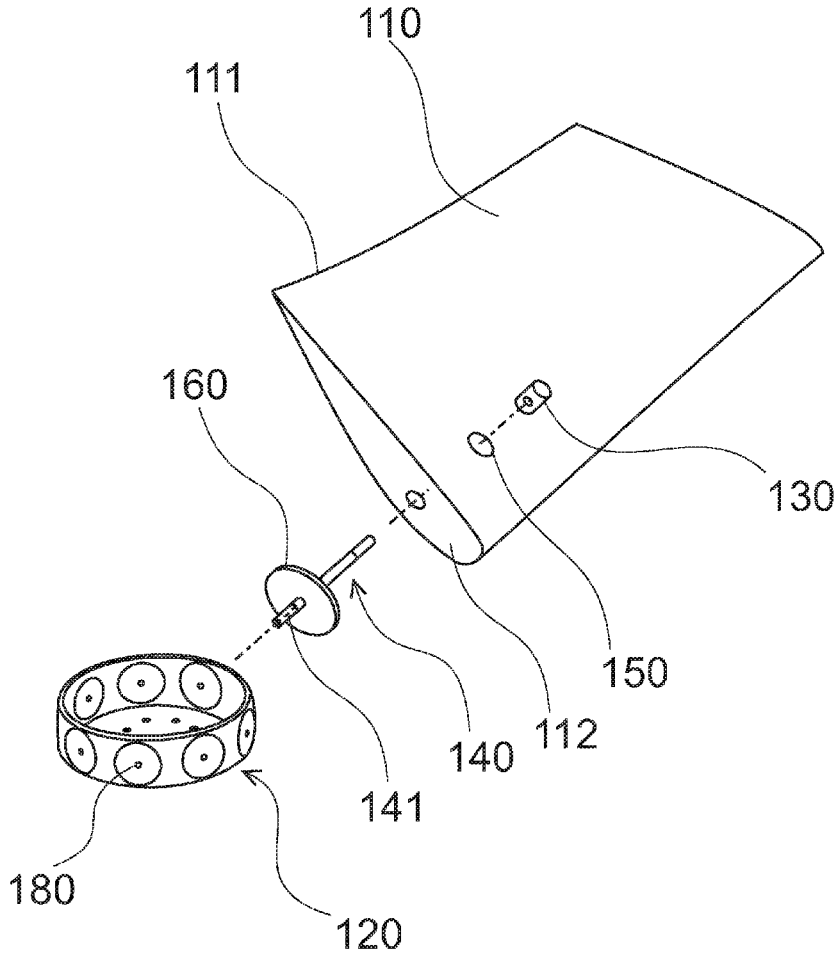
FIG. 01 is a perspective view of an embodiment of a fan blade connection system according to the invention.

This invention is not limited in its application to the details of construction and the arrangement of components set forth in the following description or illustrated in the drawings. The invention is capable of other embodiments and of being practiced or carried out in various ways. Also, the phraseology and terminology used herein is for the purpose of description and should not be regarded as limiting. The use of 'including', 'comprising', or 'having', 'containing', 'involving', and variations thereof herein, is meant to encompass the items listed thereafter and equivalents thereof as well as additional items.

FIG. 1 illustrates one exemplary embodiment of the present invention with a fan blade connection system for connecting a composite blade (110) to a rotor hub (120), wherein said connection system comprises one fastener element (130) arranged in the blade root (111) and extending essentially transversally to the longitudinal axis of the blade (110), said fastener element (130) being adapted for receiving one of the ends of one tensioning member (140) in a relatively longitudinal position in relation to said blade (110). The blade root (111) is a region located near to the blade base (112) that will be connected to the rotor hub (120).

The said fastener element (130) may be a barrel nut or cross dowel, a channel nut, a cross bolt, a teebolt, a clip, a nut with spring clips, or other similar element suitable to be inserted or moulded into the fan blade (110) and to provide a fixed connection for the tensioning member (140). In the embodiment shown in FIG. 1, the fastener element (130) is a barrel nut anchoring the tensioning member (140). The terms 'barrel nut' and 'cross dowel' are commonly used as synonyms for a kind of device, as shown in FIG. 1, with a lateral entry for transversally screwing a bolt, a stud or a similar tensioning member (140). Sometimes the term 'barrel nut' is also used to designate a type of fastener that has a flange and a protruding boss that is internally threaded, wherein the boss sits within the components being fastened, and the flange provides the clamping force. The external side of the flange, also called 'head', usually has a drive to drive in or extract out the barrel nut from the components being fastened. Both kinds of barrel nuts may be used for the purposes of the present invention; however, the first kind shown in FIG. 1 is the preferred one because it may be inserted into a simple circular hole, distributing the stresses resultant from anchoring the tensioning member (140) along the transversal axis of the blade (110), as well as allows simple replacement and adjustments. The second kind of device has the disadvantage of requiring an additional tool or assembly to avoid that the device turns around its longitudinal axis when screwing the tensioning member (140).

The fastener element (130) can be suitable for receiving more than one tensioning member (140) and can be inserted into a hole (150) that completely or partially passes through the blade (110).

The tensioning member (140) may be a stud, a screw, a bolt, or a similar member suitable to fixedly connect one of its ends to the fastener element (130) arranged inside the blade (110). In the embodiment shown in FIG. 1, the tensioning member (140) is a stud.

As the geometry, materials and sizes of a composite blade may vary depending upon the application; the blade root (111) may vary accordingly, being not limited by the exemplary embodiment shown in FIG. 1. Although the fastener element (130) extends essentially transversally to the longitudinal axis of the blade (110) and the tensioning member (140) in a relatively longitudinal position, depending upon the design of the blade equivalent arrangements may be suitable to a distribution of the stresses throughout the blade root (111). The number of fastener elements (130) and tensioning members (140) may also vary depending upon the design of the blade (110) and the rotor hub (120). The use of one single fastener element (130) for more than one tensioning member (140), as well as the definition if the hole (150) shall completely or partially pass through the blade (110), may vary according to the blade design. For instance, in a relatively thick blade (110), it may be more suitable to have one or more holes (150) that only partially pass through the blade (110). The fastener element (130) may extend through the entire blade thickness or only partially. It may be desirable, for example, that the fastener element (130) be accessible for adjustment of the arrangement or replacement of the blade (110). Alternatively, the fastener element (130) may be inserted into the hole (150) and covered by additional laminated layers. The selection of the most suitable combination of fastener elements (130) and tensioning members (140) also depends on the design of the blade (110). The number of composite blades (110) that are connected to a rotor hub (120) also depends on custom specifications. All these variations are due to different specific industrial ventilation and cooling applications for which fans may be made and used, hence, are not intended to limit the scope of the invention, which may be practiced by a person skilled in the art based on this disclosure.

Figure 4:
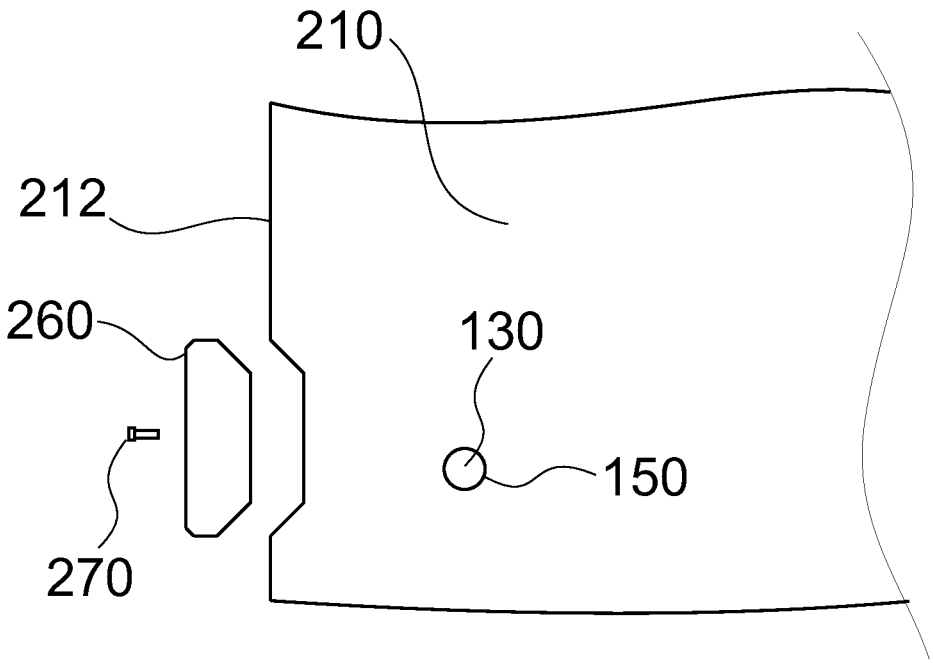
FIG. 04 is a view of an embodiment of a blade root including a recess.
Figure 5:
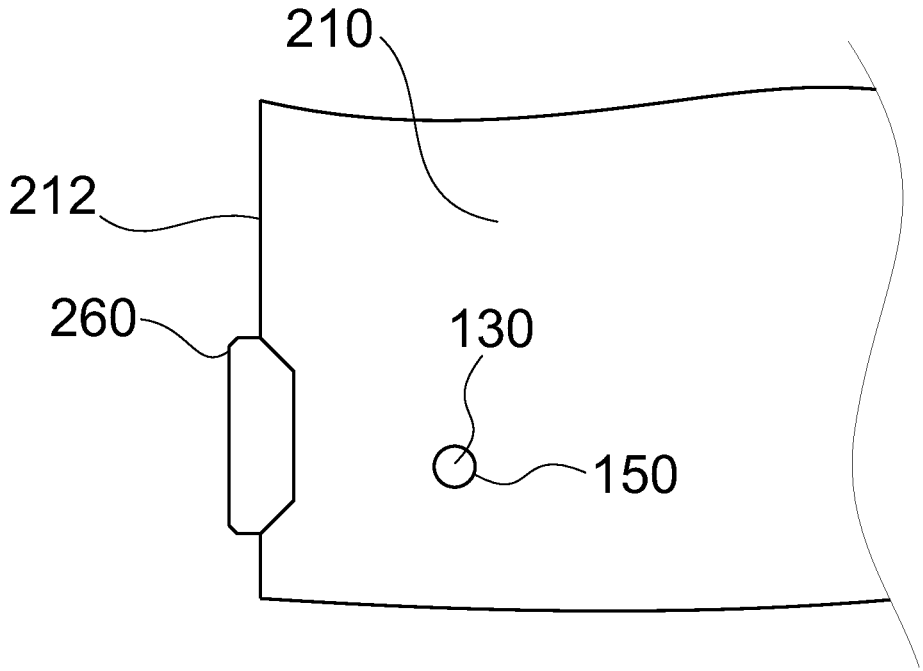
FIG. 05 is another view of the blade root including the recess having the intermediary interface positioned therein.

In the embodiment shown in FIG. 1, the tensioning member (140) may have an intermediary interface (160) part between the blade (110) and the rotor hub (120). In the example shown in FIG. 1 the intermediary interface (160) part is formed integrally with the tensioning member (140); however, the intermediary interface (160) part may be an equivalent separate component, such as a washer or a flat disk. The intermediary interface (160) part avoids direct contact between the composite blade (110) and the rotor hub (120), which is commonly metallic. Hence, the intermediary interface (160) part may be metallic or any other equivalent material that prevents wearing of the composite blade (110) due to friction and stresses. The intermediary interface (160) part may be optionally positioned in a recess made in the blade base (112). FIGS. 4 and 5 illustrate an embodiment in which a recess is formed in a blade base (212), and an intermediary interface (260) is positioned within the recess.

The end (141) of the tensioning member (140) that is not connected to the fastener element (130) is connected to one of the holes (180) in the rotor hub (120) in the embodiment shown in FIG. 1. This connection may be of any kind suitable to fixedly connect the tensioning member (140) to the rotor hub (120), such as a threaded connection, a mortised connection or a welded connection.

As the barrel nut has a laterally extending entry with an inner thread for screwing the stud, it is possible to have a fixed connection, which in turns distributes the stresses throughout the blade, more particularly in the longitudinal and transversal axes of the blade root. Hence, while the barrel nut anchors the stud, the stud presses the rotor hub (120) against the intermediary interface (160) part and the composite blade (110).

The exemplary embodiment shown in the FIG. 1 is, generally, the best mode for small and medium fan blades connections.

Figure 2:
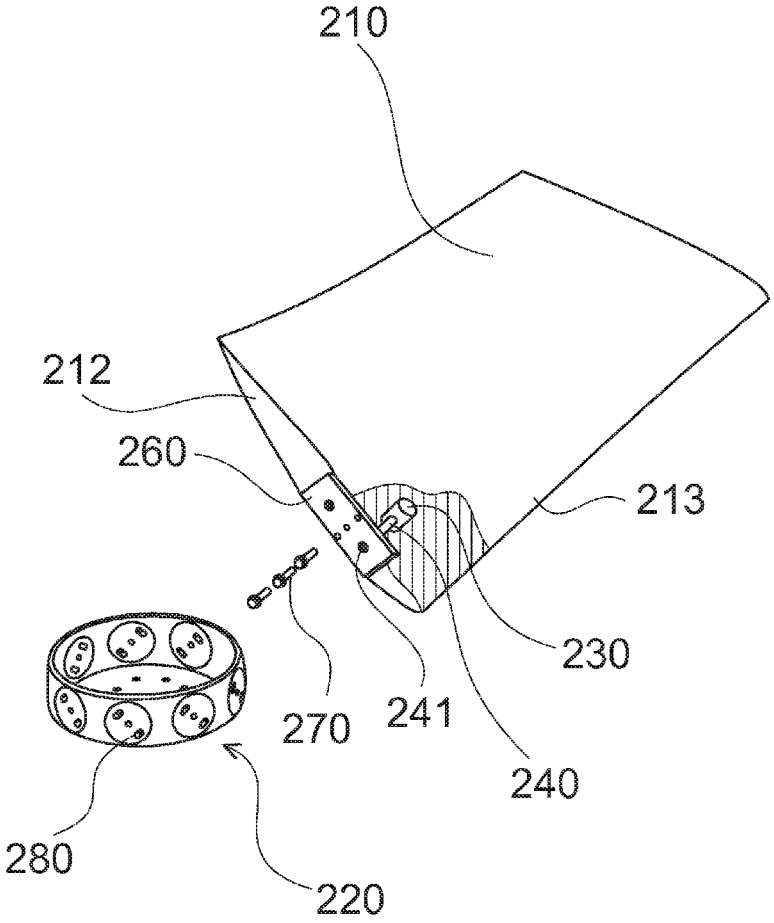
FIG. 02 is a perspective view of another embodiment of a fan blade connection system according to the invention.

FIG. 2 shows another exemplary embodiment of a fan blade connection system according to the invention, wherein the end (241) of the tensioning member (240) that is not connected to the fastener element (230) fixes an intermediary interface (260) part to the blade base (212). In the embodiment shown in FIG. 2, there are two fastener elements (230), one positioned near the leading edge (213) of the blade (210) and one positioned in the opposite side to the symmetry axis of the intermediary interface (260) part. For each fastener element (230) there is one tensioning member (240). The tensioning member (240) can be a stud with or without head. If the stud does not have a head, a nut screwed in the end (241) which is not connected to the fastener element (230) presses the intermediary interface (260) part against the blade (210). If the stud has a projected head, e.g. a bolt, the head of the bolt presses the intermediary interface (260) part against the blade (210). Although the embodiment shown in FIG. 2 illustrates two tensioning members (240) and respective fastener elements (230), depending upon the design of the blade (210) and the fan, there may be less or more tensioning members (240) and fastener elements (230).

In the embodiment shown in FIG. 2, the attachment between the blade (210) and the rotor hub (220) is provided by three fastener components (270), which pass through holes (280) in the rotor hub (220) and in the intermediary interface (260) part connecting the said rotor hub (220) to the said intermediary interface (260) part. In the embodiment shown, the fastener component (270) is a bolt.

Figure 3:
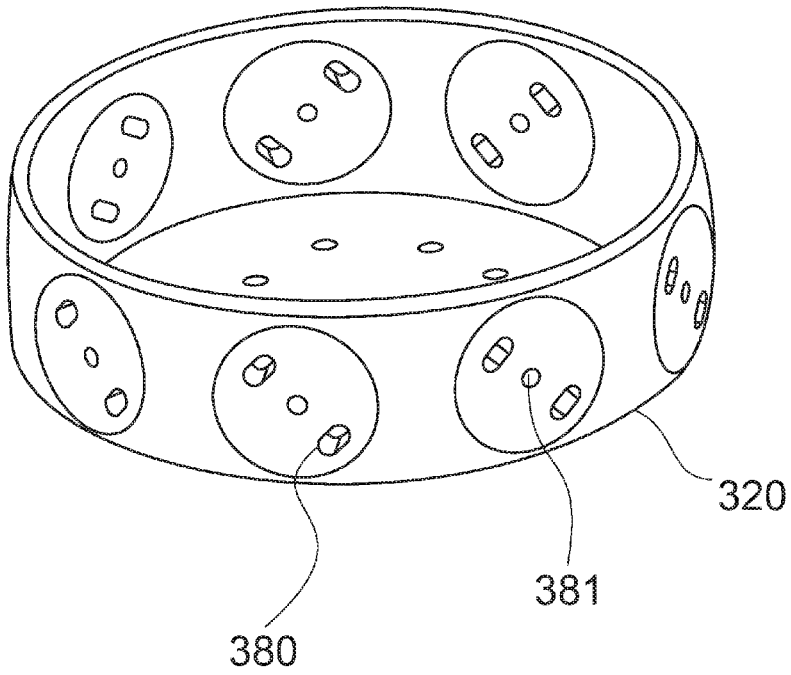
FIG. 03 is a perspective view of the rotor hub.

FIG. 3 shows a view of the rotor hub (320), wherein the rotor hub holes (380) for the fastener components (not shown) are of a non circular shape, such as oblong, rip or the like, and wherein the central rotor hub hole (381) has a circular shape.

The exemplary embodiment shown in the FIGS. 2 and 3 is, generally, the best mode for large fan blades connections.

Some embodiments of the present invention may be carried out by a method of connecting a composite fan blade to a rotor hub comprising the steps of inserting a plurality of barrel nuts arranged in the blade root and extending transversally to the longitudinal axis of the blade, each of said barrel nuts fastening one of the ends of one stud, said studs arranged in parallel position in relation to the longitudinal axis of the blade and wherein the other end of the studs fixes an intermediary interface part to the blade base; inserting a plurality of bolts through the rotor hub and the intermediary interface part; and attaching said rotor hub to the composite blade by fastening said bolts.

The invention claimed is:

1. A fan blade connection system for connecting at least one composite blade to a rotor hub, the system comprising:

an intermediary interface part disposed between a blade root of the blade and the rotor hub;

a tensioning member having a first end inserted into the blade root and a second end attached to the intermediary interface part;

a fastener element arranged in the blade root and extending substantially transversally to a longitudinal axis of the blade, the fastener element adapted for receiving the first end of the tensioning member in a substantially longitudinal position in relation to said blade and for attaching the tensioning member to the blade root; and a fastener component having a first end attached to the intermediary interface part and a second end connected to the rotor hub, wherein the fastener component extends substantially parallel to the tensioning member;

wherein the fastener element and the intermediary interface are each configured to be in direct contact with a portion of the blade root comprising a composite material, and wherein the intermediary interface has a cross-sectional area, in a plane normal to the longitudinal axis of the blade, that is smaller than a cross-sectional area of the portion of the blade root comprising the composite material, in the plane normal to the longitudinal axis of the blade.

2. The fan blade connection system according to claim 1, wherein the fastener element is configured to be inserted or moulded into the blade root and to provide a fixed connection for the tensioning member.

3. The fan blade connection system according to claim 2, wherein said at least one fastener element is one of a barrel nut, a cross dowel, a channel nut, a cross bolt, a teebolt, a clip, and a nut with spring clips.

4. The fan blade connection system according to claim 1, wherein the fastener element is configured to receive more than one tensioning member.

5. The fan blade connection system according to claim 1, wherein the fastener element is configured to be inserted into a hole that completely passes through the blade root.

6. The fan blade connection system according to claim 1, wherein the fastener element is configured to be inserted into a hole that partially passes through the blade root.

7. The fan blade connection system according to claim 1, wherein the tensioning member is configured such that the first end of the tensioning member is fixedly connected to the fastener element arranged inside the blade root.

8. The fan blade connection system according to claim 7, wherein said tensioning member is one of a stud, a screw, and a bolt.

9. The fan blade connection system according to claim 1, wherein the intermediary interface part is metallic.

10. The fan blade connection system according to claim 1, wherein the fastener component is a bolt or a screw.

11. A fan blade connection system for connecting at least one composite blade to a rotor hub, the system comprising:

at least one tensioning member configured to be inserted into a blade root of the blade and to be attached to the rotor hub, wherein the at least one tensioning member comprises an intermediary interface, pad between the blade coot and the rotor hub; and at least one fastener element configured to be arranged in the blade root and to extend substantially transversally to the longitudinal axis of the blade, the at least one fastener element adapted for receiving one of the ends of the at least one tensioning member in a substantially longitudinal position in relation to said blade and for attaching the at least one tensioning member to the blade;

wherein the at least one fastener element and the intermediary interface are each configured to be in direct contact with a portion of the blade root comprising a composite material, wherein said at least one tensioning member is configured to fixedly connect one of its ends to the fastener element arranged inside the blade root, and wherein the end of the at least one tensioning member, which is not connected to the fastener element, is configured to be connected to one of a plurality of holes in the rotor hub.

12. The fan blade connection system according, to claim 11, wherein the plurality of holes in the rotor hub are of a non circular shape.

13. The fan blade connection system according to claim 11, wherein at least one of the plurality of holes in the rotor hub has a circular shape.

14. The fan blade connection system according to claim 11, wherein the intermediary interface part is formed integrally with the at least one tensioning member.

* * * * *